US009656455B2

(12) United States Patent
Sun

(10) Patent No.: US 9,656,455 B2
(45) Date of Patent: May 23, 2017

(54) DRIVE DEVICE FOR STAMPING FOIL, UNWINDING MODULE AND STAMPING MACHINE THUS EQUIPPED

(71) Applicant: BOBST MEX SA, Mex (CH)

(72) Inventor: Xiguang Sun, Prilly (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 14/390,618

(22) PCT Filed: Mar. 21, 2013

(86) PCT No.: PCT/EP2013/000849
§ 371 (c)(1),
(2) Date: Oct. 3, 2014

(87) PCT Pub. No.: WO2013/149703
PCT Pub. Date: Oct. 10, 2013

(65) Prior Publication Data

US 2015/0075394 A1 Mar. 19, 2015

(30) Foreign Application Priority Data

Apr. 4, 2012 (EP) ..... 12002436

(51) Int. Cl.
*B65H 23/18* (2006.01)
*B41F 19/02* (2006.01)
(Continued)

(52) U.S. Cl.
CPC ..... *B41F 19/02* (2013.01); *B41F 19/068* (2013.01); *B65H 16/106* (2013.01);
(Continued)

(58) Field of Classification Search
None
See application file for complete search history.

(56) References Cited

U.S. PATENT DOCUMENTS 2,342,203 A * 2/1944 Kohler ..... B65H 23/085 118/235
3,740,296 A * 6/1973 McDonald ..... B65H 19/00 242/555.4

(Continued)

FOREIGN PATENT DOCUMENTS

EP 1 588 968 A1 10/2005
EP 2 383 212 A1 11/2011
FR 2 775 633 A1 9/1999

OTHER PUBLICATIONS

International Search Report dated Jun. 11, 2013 issued in corresponding International patent application No. PCT/EP2013/000849.

*Primary Examiner* — Jill Culler
(74) *Attorney, Agent, or Firm* — Ostrolenk Faber LLP

(57) ABSTRACT

Drive device for unwinding a reel of foil in an unwinding module of a stamping machine, having an inactive position, and an active position in engagement with the reel, and comprising: a belt, having an inactive configuration, and an active configuration for contacting a portion of the reel and driven by a driver of the module so as to unwind the reel, rollers, maintaining the belt in the inactive and the active configuration, a translatable roller, which engages the belt and compensates for variations in length when the belt moves from the inactive to the active configuration, and a biasing arrangement, attached to the roller and thereby keeping the belt tensioned in both the inactive and the active configuration, and the biasing arrangement is actuated and disengaged from the belt, to move the belt from the inactive to the active configuration and vice versa.

11 Claims, 3 Drawing Sheets

(51) Int. Cl.

| | |
|---|---|
| ***B41F 19/06*** | (2006.01) |
| ***B65H 20/06*** | (2006.01) |
| ***B65H 18/14*** | (2006.01) |
| ***B65H 16/10*** | (2006.01) |
| *B26F 1/40* | (2006.01) |

(52) U.S. Cl.

CPC ..... *B65H 18/145* (2013.01); *B65H 20/06* (2013.01); *B26F 1/40* (2013.01); *B65H 2301/4493* (2013.01); *B65H 2301/44322* (2013.01); *B65H 2301/5126* (2013.01); *B65H 2403/25* (2013.01); *B65H 2801/81* (2013.01)

(56) References Cited

U.S. PATENT DOCUMENTS

| | | | | | |
|---|---|---|---|---|---|
| 4,893,763 | A * | 1/1990 | Wales | B65H 16/06 | 242/420.3 |
| 5,172,871 | A * | 12/1992 | Schutt | B65H 18/22 | 242/535.1 |
| 5,730,389 | A * | 3/1998 | Biagiotti | B65H 19/1852 | 156/502 |
| 6,039,285 | A * | 3/2000 | Biagiotti | B65H 16/106 | 242/563 |
| 6,387,201 | B1 | 5/2002 | Stuart et al. | | |
| 7,344,104 | B2 * | 3/2008 | Hada | B65H 16/106 | 242/420.2 |
| 7,458,538 | B2 * | 12/2008 | Betti | B65H 16/10 | 242/420.1 |

* cited by examiner

DRIVE DEVICE FOR STAMPING FOIL, UNWINDING MODULE AND STAMPING MACHINE THUS EQUIPPED

CROSS-REFERENCE TO RELATED APPLICATIONS

The present application is a 35 U.S.C. §§371 national phase conversion of PCT/EP2013/000849, filed Mar. 21, 2013, which claims priority of European Patent Application No. 12002436.9, filed Apr. 4, 2012, the contents of which are incorporated by reference herein. The PCT International Application was published in the French language.

FIELD OF THE INVENTION

The present invention relates to a drive device for rotatively driving a reel of stamping foil.

Disclosed is an unwinding module for stamping foil, equipped with at least one such drive device. Also disclosed are a stamping machine for the manufacture of packaging comprising at least one such drive device; and such a stamping machine provided with an unwinding module equipped with at least one such drive device.

BACKGROUND

In the area of the manufacture of packaging, for example that destined for the luxury industry, a converting machine by stamping applies patterns onto a sheet element by means of pressure. The patterns, for example usually metallized texts and/or decorations, are obtained by means of a shape to be stamped or a plate. The patterns originate from portions of a film derived from one or more stamping foils.

In the stamping machine, the sheet elements are taken off a stack located upstream, gripped by a conveyor and brought one after the other into a stamping platen press carrying the plate. The plate is mounted on the top fixed beam of the press. A stamping counterpart corresponding to the plate is mounted on the bottom mobile platen of the press. In the case of hot stamping, known as "hot foil stamping", the plate is heated. The metallized stamping foils are driven between the running plane of the sheet elements and the top beam.

In a vertically upward movement, the bottom movable platen will press the stamping foil against each sheet element between the plate and its counterpart in order to deposit portions of film there. Once the film has been deposited, the bottom platen goes down again and the stamped sheet element is then released by the gripper bar onto a stack in a delivery in order to leave space for the new sheet element following.

In the same space of time, the stamping foil is displaced so that a new surface of the film is matched to the plate. The transport of the foils requires intermittent means for unwinding and advancing generally provided by rolls against which the foils are nipped by the pressing rollers. The motorized drive of these rolls allows for the intermittent advancing of these foils.

The majority of patterns deposited on the packaging can be realized from stamping foils with a small web width, generally not exceeding 30 cm. However, it is sometimes necessary to use stamping foils with a larger web width, typically in the order of between 50 cm and 70 cm. A set of narrower foils disposed side by side where the overall accumulated web width reaches this order of size can also be used.

The reels of stamping foils are stocked in an unwinding module. In this module, the foils are driven in order to be unwound there. The module serves for supporting the reels and for supplying the machine with the foil or foils. In numerous stamping machines, the module is like a cabinet located at the rear outside said machines. The module has a bearing structure in which are arranged one or more reel carriers, each one of which supports at least one reel. There are two systems for unwinding the stamping foil.

EP 1588968 describes one of the two systems, having a drive device for reels which are mounted so as to be freely rotatable on their respective reel carrier. The device comprises a belt which manages the advancing and braking function of the unwinding of the reel and therefore the supply of stamping foil to the machine. Rotational synchronization is ensured thanks to the friction of the belt both against a drive axle and against the reel. The belt of the device is tensioned by a spring.

However, when the operator puts the device into the active position on a reel, the belt automatically makes the reel turn. This phenomenon leads to waste of stamping foil.

A second disadvantage observed is the difficulty of putting several devices into the active position on one wide reel. Once a first device is placed into position on a larger width reel, this latter is blocked by the drive axle as the reel and the drive axle are coupled by the tensioned belt. When the operator has to put a second device into position on the same reel, the belt of the second device tries to turn this reel which is already blocked by the first device. The operator thus has to press very strongly and with a great deal of effort to put the second device on the reel. The forcing makes it difficult to place this second device in position and the foil is very greatly crumpled on the surface of the reel.

Yet another disadvantage is a shortcoming in the operating area. As the reel is unwound, it has less inertia but turns more quickly. Without disregarding the inertia of the hub, the power required is greater than for the full reel, in the case of a reel with a larger width. On account of the spring principle, the tension of the belt decreases and results in this belt sliding over its surface, at the end of the reel. In this case, it is necessary to reduce the rate in order to compensate for this phenomenon.

SUMMARY

To address these disadvantages, a principal aim is to refine a drive device for unwinding a reel of foil in an unwinding module in a stamping machine. A second aim is to make a drive device simpler and to reduce the time taken to put it into an active position. A third aim is to resolve the technical problems mentioned for the prior art document. A fourth aim is to provide an unwinding module incorporating one or more drive devices for one or more reels. A fifth aim is to incorporate a device in a stamping machine. Yet another aim is that of realizing a stamping machine with an unwinding module.

Accordingly, described is a drive device for unwinding a reel of foil for an unwinding module for a stamping machine, this drive device comprising:

- a belt, having an inactive configuration, and an active configuration for contacting a portion of a peripheral circumferential surface of the reel and driven by a driver of the module so as to unwind the reel,
- a series of rollers, maintaining the belt in the inactive configuration and in the active configuration, a translatable roller, which engages the belt and thereby compensates for variations in length when the belt moves from the inactive configuration to the active configuration and a biasing arrangement, attached to the movable roller and thereby keeping the belt tensioned in both the inactive configuration and in the active configuration.

In accordance with one aspect of the present invention, the drive device is characterized in that the biasing arrangement is able to be disengaged and to be actuated in order to move the belt from the inactive configuration to the active configuration and vice versa.

In other words, the biasing arrangement is not passive. It provides two functions. On the one hand, it couples the drive device and the reel via the tensioned belt. On the other hand, the tension of the belt is controlled throughout the unwinding of the reel.

The biasing arrangement maintains the belt at a constant tension when following the unwinding of the reel, thus suppressing the shortcoming in the operating area. Furthermore, the tension of the belt can be adapted as a function of the necessary power, the quality of the hub and the quality of the unwinding of the foil.

At the moment when the device is put into the active position and the belt is put into the active configuration, the coupling between the reel and the drive shaft is removed by the operator. Prior to being put into the active position and into its inactive configuration, the belt is slack or weakly tensioned.

The disengageable and actuatable means only ensure the belt is tensioned once the device has been put into the active position. By way of the disengageable and actuatable means, the belt is tensioned at the last moment of being put into the active position. A slack or weakly tensioned belt during take-up of the active position neither makes the reel turn to no purpose, nor does it make it block the reel. Taking up the position becomes much more ergonomic.

The foil is defined, by way of non-restricting example, as being a metallized foil, for example aluminized, gilded, colored or other types also.

In another aspect of the invention, an unwinding module for a stamping machine is characterized in that this unwinding module is equipped with at least one drive device for the reel of stamping foil, having one or more of the technical features described below and claimed.

According to another aspect of the invention, a machine for stamping patterns on a sheet element is characterized in that this machine comprises at least one device having one or more of the technical features described below and claimed.

According to yet another aspect of the invention, a machine for stamping patterns on a sheet element is characterized in that this machine is provided with an unwinding module having one or more of the technical features described below and claimed.

The sheet element is defined, by way of non-restricting example, as being in a material such as paper, flat cardboard, corrugated cardboard, laminated corrugated cardboard, flexible plastic, for example polyethylene (PE), terephtalate polyethylene (PET), bioriented polypropylene (BOPP), or other polymers, or also other materials.

The front is defined in relation to the front face of the machine, from the side of the control desk of the machine, known as the "operator's side". The rear is defined in relation to the rear face of the machine on the side opposite the control desk of the machine, known as "opposite the operator's side".

BRIEF DESCRIPTION OF THE DRAWINGS

The invention will be well understood and its various advantages and different characteristics will emerge better by way of the following description of the non-restricting exemplified embodiment, with reference to the accompanying schematic drawings, in which.

DETAILED DESCRIPTION OF THE PREFERRED EMBODIMENTS

Figure 1:
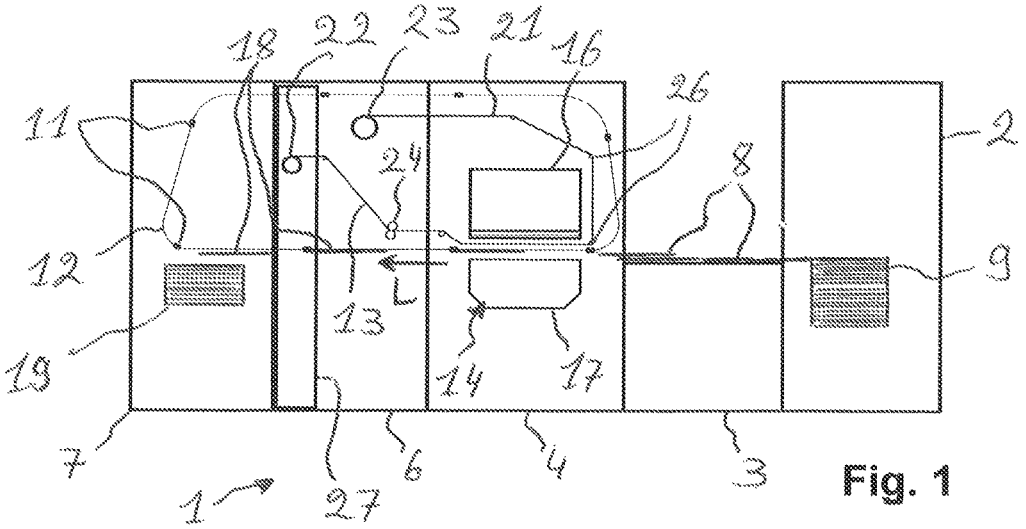
FIG. 1 shows an elevational view of a stamping machine provided with an unwinding module.

As illustrated in FIG. 1, a hot foil stamping machine, in the present case a gilding machine 1, comprises, in sequence, different stations 2, 3, 4, 6 and 7 which are placed side by side and are interdependent. From upstream to downstream the machine 1 comprises an infeed station 2, a feed table 3, a stamping station 4, a station for supplying and recovering foil 6 and a delivery station 7.

The sheet elements, in the present case cardboard sheets 8, having to be covered with gilded patterns, are placed into the machine 1 in the infeed station 2 in the form of a stack 9. The sheets 8 are removed one by one from the top of the stack 9 and are placed in shingle stream on the feed table 3. At the end of the shingle stream, the front sheet is positioned precisely. Each sheet is then gripped and conveyed individually from the output of the feed table 3 through the machine 1 as far as up to the delivery station 7 by a conveyor.

The conveyor is generally constituted by a gripping member, in this case a series of grippers, each being mounted on a transverse gripper bar 11 which is movable longitudinally. The gripper bars 11 are attached to two endless gripper bar chains 12, disposed laterally on each side of the machine 1, and drive the sheets to be covered 8 in the longitudinal direction (arrow L). The gripper bar 11 grips the sheet to be covered 8 and the gripper bar chains 11 brings it into the successive stations 4, 6 and 7 in a rated running.

The gripper bar chains 12 are set in motion, run through a loop and stop periodically in a rated running such that during conveying, each gripper bar 11 with its sheet 8 is moved from an upstream station to the adjacent downstream station. The position of the stops of the gripper bars 11 is constant.

The function of the stamping station 4 is to deposit on each sheet 8, by hot foil stamping, metalized film, in this case gilded film, derived from a stamping foil 13. In the case of the gilding, the foil 13 is formed with a layer of gold laminated on a plastic support foil. The stamping operation is carried out with a platen stamping press 14, between a top beam 16 which is static and a bottom platen 17 which is mounted so as to be movable following a vertical alternating movement stroke.

Stamping tools (not visible) are associated with each of the platens 16 and 17. The plate is mounted on the bottom face of the top beam 16 and the stamping counterpart corresponding to the plate is mounted on the top face of the bottom platen 17. The plate is heated for hot foil gilding.

The sheet covered with gilded patterns 18 is automatically released by the gripper bar 11 at the delivery station 7. The sheets covered with gilded patterns are then removed in a stack 19 from the machine 1.

The station for supplying and recovering foil 6 is placed downstream of the stamping station 4 and is responsible both for supplying the machine with stamping foil 13 and for removing this used foil 21 once it has been utilized. The stamping foil 13 is stored in a wound form in a rotatably mounted supplying reel 22. In a similar manner, after passing through the stamping press 14, the used foil 21 is wound around a rotatably mounted recovery reel 23.

Between its storage point and its recovery point, the foil 13 is driven to move by a drive system which makes it run. The running path starts with the supplying reel 22, passes especially through the stamping press 14 and ends by the recovery reel 23. The drive system comprises a tension shaft and its pressing roller 24, positioned downstream of the path and driven at an overspeed to pull the foil 13. The drive system comprises a series of diverting bars 26 set up along the path to guide the movement of the stamping foil 13 and of the used foil 21.

In the majority of cases, the stamping of patterns onto the sheet 8 requires the simultaneous use of several reels 22 (not shown in the figures). The sheet 8 has to be covered with patterns at numerous different places according to a particular position as a function of the desired decoration for the final packaging. The operator thus establishes a layout for the sheet 8.

It is preferable from a cost view, therefore, to use several reels 22 with smaller widths rather than to use one single reel 22 with a large width. The loss of surface on used foil 21 which is not stamped and laminated with gold and located in the recovery reel 23 is less important with several reels 22 with smaller widths than with one single reel 22 with a large width. The reels 22 with the smaller widths have to be positioned precisely as a function of the layout.

The supplying reel or reels 22 are placed and unwound at the station supplying and recovering foil 6 and more particularly thanks to an unwinding module 27. The module 27 is like a cabinet and is located outside the machine 1, so that an operator has ergonomic access to the machine 1 and can easily load new supplying reels 22. The module 27 is installed at the rear of the machine 1, on the side opposite the control desk of the machine 1, known as "opposite the operator's side". The foil 13 enters into the machine 1 by one of its rear faces.

One or more supplementary reels 22 are placed in storage in the module 27 so that the operator is able to prepare the later stamping job which is going to follow the stamping job currently being produced.

Figure 2:
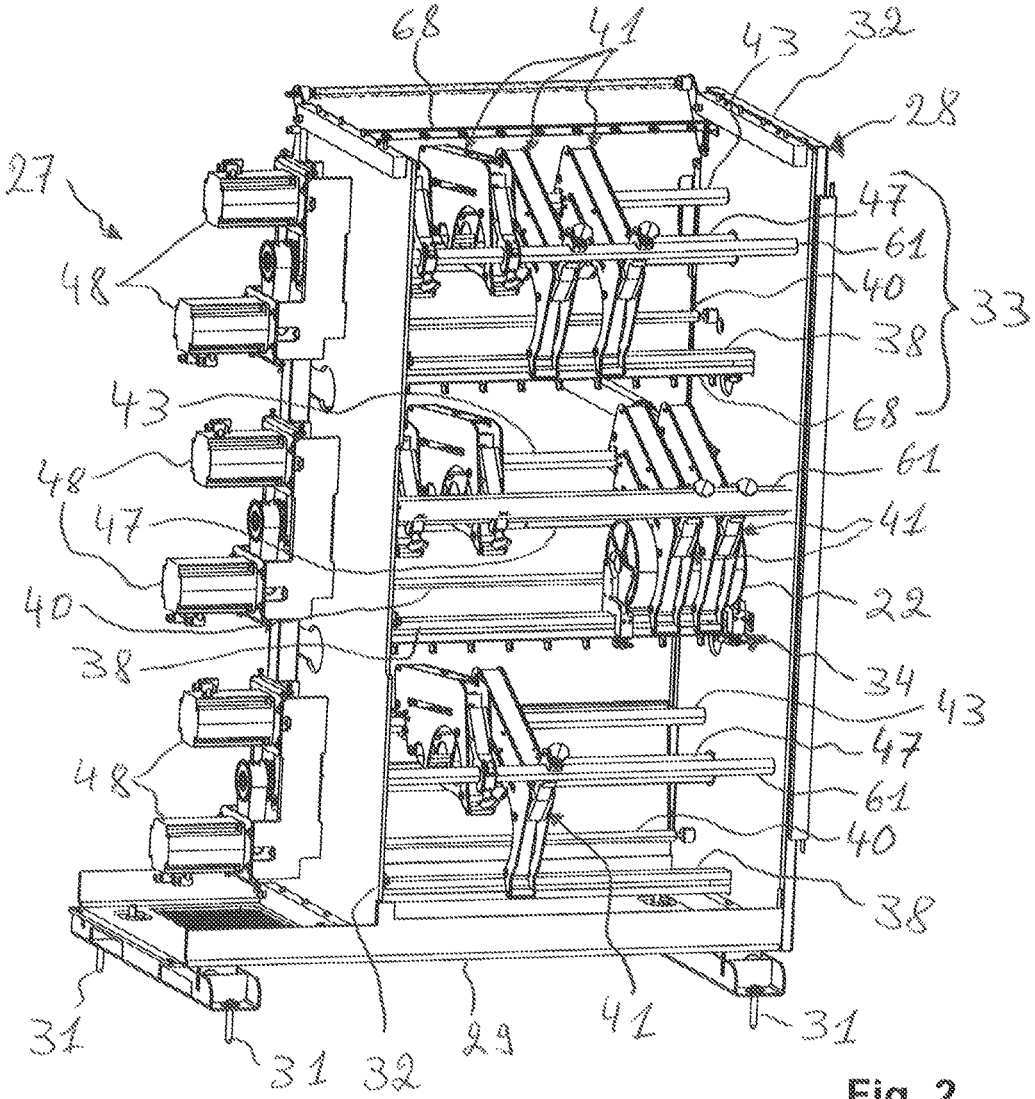
FIG. 2 shows a rear view in perspective of the unwinding module of FIG. 1, comprising drive devices.

The module 27 comprises a frame 28, with a base 29, four feet 31 and two vertical side walls 32 which are parallel with one another (see FIG. 2). Several levels 33, in this case three levels, disposed one above the other, are arranged in the module 27. Each level 33 is provided in order to support at least one reel 22 and to supply the machine 1 by unwinding this reel or reels 22.

Each reel 22 is maintained on a reel support 34. The reel support 34 comprises two vertical flanks 36 maintaining the sides of the reel 22 and a maintaining axle 37 whilst allowing the reel 22 to rotate freely (see FIGS. 2 to 4).

Each level 33 of the module 27 comprises a crossbar 38 like a spacer which is substantially horizontal between the two walls 32. The crossbar 38 is positioned substantially at the middle of the module 27. At least one reel support 34 carrying one reel 22 is placed on the crossbar 38 and is fastened thereto.

The reel support 34 and its associated reel 22 are mounted to slide along the crossbar 38 so as to be positioned by the operator in a precise manner as a function of the layout established for the sheet 8. To do this, a bottom part of the two flanks 36 of the reel support 34 has a fastener with a concave form in a slot. The fastener complements the square profile of the crossbar 38. The two flanks 36, and thus the reel support 34, are perpendicular to the crossbar 38. The holding axle 37 for the reel 22 is parallel to the crossbar 38. A lug 39 locks the reel support 34 on the crossbar 38. When leaving the reel 22, the foil 13 is held by a foil return 40 and then enters the machine 1 by the rear.

The reel 22 is unwound thanks to a drive device 41 which is mounted in the module 27. Each reel 22 is rotatively driven and unwound by one or more devices 41, this number being a function of the width of the reel 22. The device or devices 41 can move from an inactive position, without entering into contact and therefore without driving the reel 22 (FIG. 3), to an active position in engagement with the reel 22 (FIG. 4), and vice versa.

Given that each level 33 is provided to support at least one reel 22, each level 33 is equipped with at least one device 41. Devices 41 can be placed stored in the inactive position (shown for example in FIG. 2 on the left-hand side, against the side wall 32).

The device 41 is positioned above the reel 22 that it has to drive. The device 41 comprises a structure 42 with two lateral flanges. The structure 42 has a bottom cutout allowing the reel to be unwound 22 to pass through.

Each level 33 of the module 27 comprises a rod 43 like a horizontal spacer between the two walls 32. The rod 43 is positioned substantially toward the front of the module 27. The rod 43 is parallel to and is located above the crossbar 38. At least one device 41 is attached to the rod 43.

The device 41 is mounted to slide along the rod 43, so as to be positioned and locked by the operator in a precise manner as a function of the position of the reel 22 and so as to be able to drive it.

To do this, a front part of the structure 42 preferably has an attaching member 44. The attaching member 44 has a rounded concave form. The attaching member 44 complements the round profile of the rod 43 and locks the device 41 on the rod whilst allowing for tilting. The structure 42, and therefore the device 41 are perpendicular to the rod 43.

Figure 3:
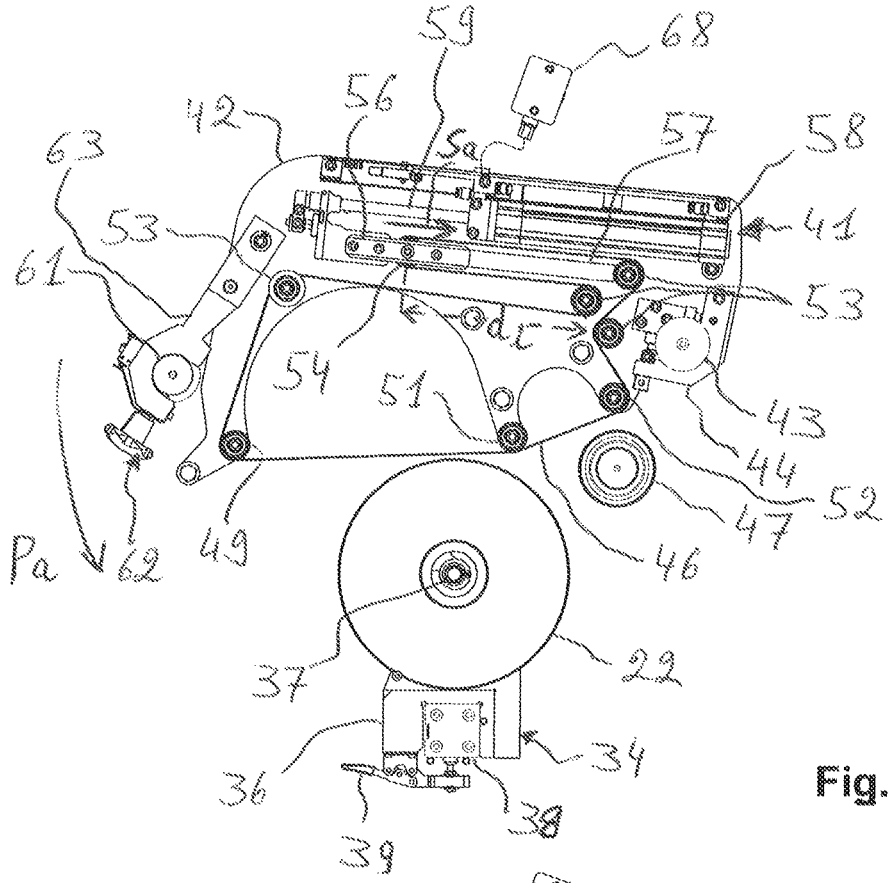
FIG. 3 shows a side view of a drive device in inactive position.

The device 41 moves from the inactive position to the active position by pivoting toward the back and toward the bottom with respect to the rod 43 (arrow Pa in FIG. 3). Conversely, the device 41 moves from the active position to the inactive position by pivoting toward the front and toward the top with respect to the rod 43 (arrow Pi in FIG. 4).

The device 41 comprises an endless drive belt 46. The belt 46 is maintained by the structure 42 along a path defined by a set of eight rollers. When the device 41 is in the inactive position, the belt 46 is located in an inactive configuration. When the device 41 is in the active position, the belt 46 is in an active configuration.

Figure 4:
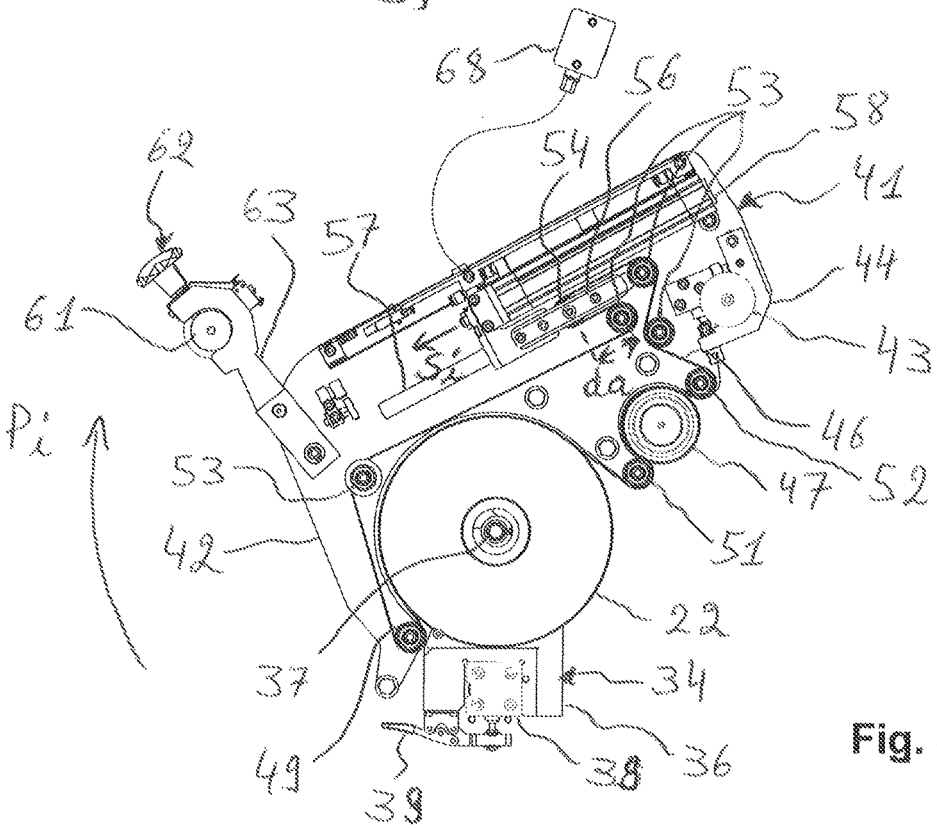
FIG. 4 shows a side view of the drive device in FIG. 3 in active position.

The belt 46 is driven along its run thanks to drive means which are present at the module 27. The drive means are an advance shaft or rotatory drive axle 47. When the device 41 is in the inactive position, the belt 46 is not driven (FIG. 3). When the device 41 is in the active position, the belt 46 comes into contact with and is driven by friction against the drive shaft 47 (FIG. 4).

Each level 33 of the module 27 comprises a drive axle 47. The drive axle 47 is positioned substantially toward the front of the module 27, between the crossbar 38 and the rod 43. The drive axle 47 is parallel to the crossbar 38 and to the rod 43. The drive axle 47 is located between the crossbar 38 and the rod 43. The structure 42, and thus the device 41 are perpendicular to the drive shaft 47.

The drive axle 47 is divided into two axle segments (not visible in the figures), each of the two segments being rotatively driven by a different motor and its associated belt 48. Each level 33 of the module 27 thus comprises two motors 48. These two axle segments 47 allow at least two devices 41 present on the same level 33 of the module 27 to be driven at different speeds. The speed of the motors 48 is controlled as a function of the layout of the sheet 8.

The device 41 comprises eight rollers pivotally mounted on the structure 42. A rear bottom roller 49 and a central bottom roller 51 allow the belt 46 to be guided and to be maintained in contact with a portion of a peripheral circumferential surface of the reel 22. In the active position, the device 41 rests on the reel 22 by means of the belt 46. The device 41 tilts (arrow Pa) relative to the rod 43 throughout the unwinding of the reel 22.

The central bottom roller 51 and a front bottom roller 52 allow the belt 46 to be guided and maintained in contact with a portion of a peripheral circumferential surface of the drive shaft 47.

In its inactive configuration, the belt 46 has a substantially rectilinear path between the rear bottom roller 49 and the central bottom roller 51 and between this same central bottom roller 51 and the front bottom roller 52 (FIG. 3).

In the active configuration of the belt 46, the unwinding of the reel 22 is synchronized with the rotation of the drive shaft 47. In this way the belt 46 has a curved path between the rear bottom roller 49 and the central bottom roller 51 when hugging the portion of the peripheral circumferential surface of the reel 22. In the active configuration, the belt 46 has a curved path between the central bottom roller 51 and the front bottom roller 52 hugging the portion of the peripheral circumferential surface of the drive shaft 47 (FIG. 4).

The belt 46 follows a path guided and maintained by four other top rollers 53. A mobile roller 54 ends the path of the belt 46, forming a variable length loop with two of the top rollers 53. The mobile roller 54 is pivotally mounted on a mobile slider 56. The slider 56 slides in a slot 57. The slot is arranged between the front and the rear of the structure 42.

The slider 56, associated with the mobile roller 54, serves to compensate for variations in length of the path of the belt 46 when the latter moves from the inactive configuration with a substantially rectilinear path to the active configuration with a curved path.

When the path is rectilinear and therefore short, the slider 56 is in the forward position such that a distance between two of the top rollers 53 and the mobile roller 54 is large (di in FIG. 3), the length of the belt 46 remaining constant. When the path is curved and therefore extended, the slider 56 is in the rearward position such that the distance between two of the top rollers 53 and the mobile roller 54 is short (da in FIG. 4), the length of the belt 46 remaining constant.

The device 41 comprises biasing means, attached to the slider 56 and therefore to the mobile roller 54. The biasing means maintains the belt 46 tensioned in the inactive configuration and in the active configuration. In the active configuration, the biasing means allow the belt 46 to fit the shape of the portion of the peripheral circumferential surface and therefore with the reducing diameter of the reel 22 as this latter unwinds.

According to the invention, the biasing means are means which are able to be actuated and disengaged in order to make the belt 46 move from the inactive configuration to the active configuration and vice versa. The biasing means are preferably in the form of a cylinder 58, for example a pneumatic cylinder. The cylinder 58 is oriented substantially from the front toward the rear, parallel to the slot 57. The cylinder 58 is attached to the structure 42 above the slot 57.

The free end of the piston rod 59 of the cylinder 58 is attached to the front part of the slider 56. When the device 41 passes Pa to the active position, the piston rod 59 of the cylinder 58 is simultaneously retracted from the rear to the front (arrow Sa in FIG. 3), the slider 56 passes from the rear to the front, which makes the belt 46 move to the active configuration. In reverse, when the device 41 passes Pi to the inactive position, the piston rod 59 of the cylinder 58 is simultaneously extended from the front to the rear (arrow Si in FIG. 4), the slider 56 passes from the front to the rear, which makes the belt 46 move to the inactive configuration.

Each level 33 of the module 27 comprises a ramp 61 like a horizontal spacer between the two walls 32. The ramp 61 is positioned substantially toward the rear of the module 27. The ramp 61 is parallel to the drive axle 47, the crossbar 38 and the rod 43. The ramp 61 is located substantially at the same height as the drive axle 47. At least one device 41 is joined to the ramp 61. The structure 42, and thus the device 41 are perpendicular to the ramp 61.

Figure 5:
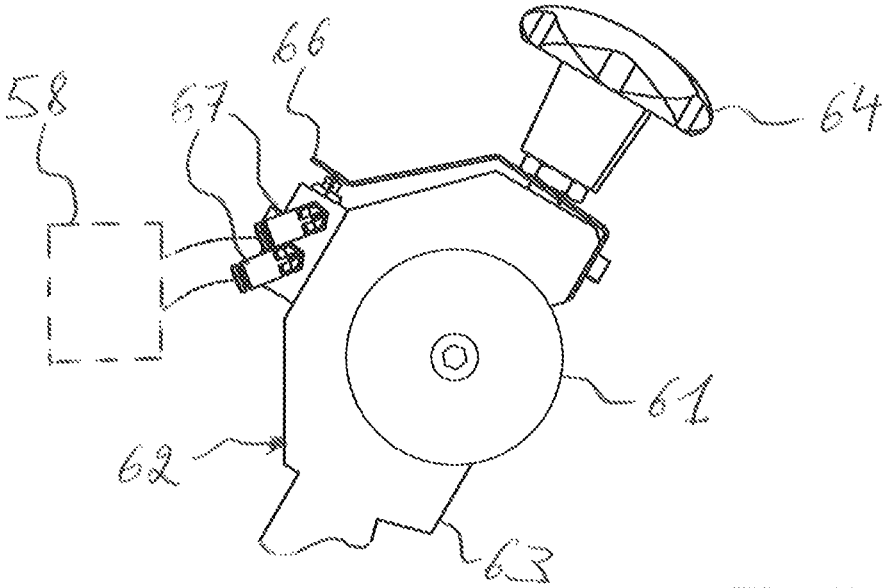
FIG. 5 shows a side view of a blocking switch of the drive device.

The device 41 is joined to the ramp 61 both in its raised inactive and in its lowered active position. To do this, the device 41 preferably comprises joining means 62 (see FIG. 5).

In a favorable manner, the joining means includes an arm 63. The arm 63 projects toward the rear of the structure 42 of the device 41. A front end of the arm 63 is maintained to the structure 42 of the device 41 whilst allowing pivoting. The arm 63 is able to pivot between a low angle in the raised inactive position and a high angle in the lowered active position.

A rear end of the arm 63 has a rounded concave form, like a hook. This shape matches the round profile of the ramp 61, which allows the arm 63 to remain joined to the ramp 61 whatever the tilted position of the device 41. Thanks to such joining, the arm 63 is mounted to slide on the rod 43, so as to be positioned and joined by the operator in a precise manner, by following the position of the device 41 on the rod 43.

The joining means 62 advantageously includes a gripping member 64. The gripping member 64 is provided at the rear end of the arm 63. The gripping member 64, in this case, is a tightening handle turned by the operator. The handle 64 makes a screw move so as to be able to join the device 41 and to maintain it on the ramp 61.

The joining means 62 favorably comprises an actuator 66 which is connected to the biasing means, i.e. in this case to the cylinder 58. The actuator 66 is in the form of a tappet and is mechanically connected to the handle 64. The actuator 66 acts on two valves 67 which are pneumatically connected to the cylinder 58 by means of a pneumatic control valve (not visible in the figures).

First of all, the operator places the reel 22 of metallized foil 13 with the reel support 34 on the crossbar 38, as a function of the layout of the sheet 8. Then, the operator moves the device 41 on the rod 43 and positions it so that the belt 46 is centered relative to the width of the reel 22. If the web width of the metallized foil 13 is large, and therefore if the width of the reel 22 is large, the operator shifts the first device 41 and adds a second device 41 by the side of the first one.

The operator then lowers the device 41, making the structure 42 tilt relative to the rod 43 and making the arm 63 pivot relative to the structure 42 such that the belt 46 moves into engagement with the drive axle 47 and with the reel 22. Thanks to the disengaged biasing means with pneumatic cylinder 58, the operator does not have to force the belt 46 to move it from its inactive configuration to its active configuration. The biasing means 58 being disengaged, the slider 56 and the mobile roller 54 move easily.

The operator then makes the handle 64 turn in one direction, simultaneously he joins the device 41 to the ramp 61, and he actuates the cylinder 58 by making it engage. The belt 46 is tensioned against the reel 22 to be unwound.

When the operator makes the handle 64 turn in the opposite direction, he disjoins the device 41 from the ramp 61 and he disengages the cylinder 58. The tension of the belt 46 can relax. The operator can then carry out the reverse operations to those described above for the device 41.

Each level 33 of the module 27 preferably comprises a compressed air distribution channel in the form of a pipe 68. The pipe 68 is positioned substantially in the middle of the module 27 and above the device 41. The pipe 68 is parallel to the drive axle 47, the crossbar 38, the rod 43 and the ramp 61. The pipe 68 is connected to the pneumatic cylinder 58 of the device 41, via the pneumatic control valve.

The pipe 68 supplies one or more devices 41 of the level 33. The devices 41 can be positioned easily and rapidly, then connected, or even disconnected, then stored at the side, without creating the least problem.

The present invention is not limited to the embodiments described and illustrated. Numerous modifications can be realized without in any way departing from the framework defined by the scope of the set of claims.

In another alternative, the biasing means 58 can be replaced by an electrically-actuated linear motor.

In another category of machines, the device or devices 41 can be incorporated in the station for supplying and recovering foil 6.

The invention claimed is:

1. Drive device for unwinding a reel of stamping foil in an unwinding module for a stamping machine, the module having a driver, said drive device having an inactive position disengaged from the driver and from the reel, and an active position in engagement with the driver and with the reel, said drive device comprising, a belt on the drive device, having an inactive configuration in which it is disengaged from the driver and from the reel, and an active configuration for contacting a peripheral circumferential surface of the driver and of the reel, the belt being thereby driven by the driver of the module so as to unwind the reel, a series of rollers, maintaining the belt in the inactive configuration and in the active configuration, a translatable roller, which engages the belt and thereby compensates for variations in length when the belt moves from the inactive configuration to the active configuration, and a biasing arrangement, attached to the translatable roller and thereby keeping the belt tensioned in both the inactive configuration and in the active configuration, a joining element joining the drive device to a first rod of the module, comprising an arm which is pivotable about the first rod for pivoting the drive device from the inactive position to the active position and vice versa, the joining element including an actuator, characterized in that the biasing arrangement is operable to be actuated by the actuator so as to keep the belt tensioned when the belt is pivoted from the inactive configuration to the active configuration and vice versa.

2. Device according to claim 1, wherein the arm is pivotable between a low angle in the inactive position and a high angle in the active position and vice versa.

3. Device according to claim 1, wherein the joining element comprises a gripping member which provides for joining the drive device by screwing it to the first rod.

4. Device according to claim 1, further comprising a fastening element, provided so as to attach the drive device to a second rod of the module, to be displaced along the second rod and to be pivoted relative to the second rod in order to move from the inactive position to the active position and vice versa.

5. Device according to claim 1, wherein the biasing arrangement comprises a cylinder.

6. Unwinding module for a stamping machine, wherein said module is provided with at least one drive device according to claim 1.

7. Module according to claim 6, where the module comprises several levels disposed one above the other, each level being provided to unwind at least one reel with at least one drive device.

8. Module according to claim 7, wherein each level comprises a driver, a first rod, a second rod and a crossbar on which is attached at least one reel support carrying a reel.

9. Module according to claim 7, wherein each level comprises a compressed air distribution channel connected to the biasing arrangement of at least one drive device, the biasing arrangement comprising a pneumatic cylinder.

10. Machine for stamping patterns on a sheet element, wherein said machine comprises an unwinding module according to claim 6, disposed at the rear, and a station disposed for supplying and recovering said stamping foil to and from said drive device.

11. Machine for stamping patterns on a sheet element, wherein said machine comprises at least one drive device according to claim 1, and a station disposed for supplying and recovering said stamping foil to and from said drive device.

* * * * *